US009672769B2

(12) United States Patent
Lee et al.

(10) Patent No.: US 9,672,769 B2
(45) Date of Patent: Jun. 6, 2017

(54) DISPLAY APPARATUS AND METHOD OF DRIVING THE SAME

(71) Applicant: SAMSUNG DISPLAY CO., LTD., Yongin, Gyeonggi-Do (KR)

(72) Inventors: Jae-Hoon Lee, Seoul (KR); Woo-Chul Kim, Seoul (KR); Seung-Ho Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/523,796

(22) Filed: Oct. 24, 2014

(65) Prior Publication Data

US 2015/0243212 A1 Aug. 27, 2015

(30) Foreign Application Priority Data

Feb. 27, 2014 (KR) ..... 10-2014-0023365

(51) Int. Cl.
*G09G 5/00* (2006.01)
*G09G 3/3216* (2016.01)
*G09G 3/3225* (2016.01)

(52) U.S. Cl.
CPC ..... *G09G 3/3216* (2013.01); *G09G 3/3225* (2013.01); *G09G 2310/0205* (2013.01); *G09G 2310/0221* (2013.01); *G09G 2320/02* (2013.01); *G09G 2320/0233* (2013.01)

(58) Field of Classification Search
CPC ..... G09G 3/3216; G09G 3/3225
USPC ..... 345/212
See application file for complete search history.

(56) References Cited

U.S. PATENT DOCUMENTS

2003/0197672 A1* 10/2003 Yun ..... G09G 3/3688 345/99
2004/0012744 A1* 1/2004 Ishige ..... G02F 1/1345 349/139
2005/0219150 A1 10/2005 Park et al.
2012/0062618 A1 3/2012 Ono
2012/0327072 A1* 12/2012 Jeon ..... H04N 13/0497 345/419

(Continued)

FOREIGN PATENT DOCUMENTS

EP 1 677 276 A1 7/2006
JP 2004-117441 4/2004

(Continued)

OTHER PUBLICATIONS

EPO Search Report dated Apr. 8, 2015, for corresponding European Patent application 14192430.8, (7 pages).

*Primary Examiner* — Towfiq Elahi
(74) *Attorney, Agent, or Firm* — Lewis Roca Rothgerber Christie LLP

(57) ABSTRACT

A display apparatus includes a display panel having a first portion and a second portion, a gate driver configured to drive a first gate line group in the first portion of the display panel starting at a first scan start point and to drive a second gate line group in the second portion of the display panel starting at a second scan start point, the second scan start point being different from the first scan start point, a first data driver configured to output a first data voltage to a first data line group in the first portion and a second data driver configured to output a second data voltage to a second data line group in the second portion.

17 Claims, 6 Drawing Sheets

(56) References Cited

U.S. PATENT DOCUMENTS

| | | | | |
|---|---|---|---|---|
| 2013/0009938 | A1* | 1/2013 | Hwang | G09G 3/348 345/212 |
| 2013/0106677 | A1 | 5/2013 | Koo et al. | |
| 2014/0049524 | A1* | 2/2014 | Yang | G09G 3/006 345/204 |

FOREIGN PATENT DOCUMENTS

| | | | |
|---|---|---|---|
| KR | 10-2004-0094146 | A | 11/2004 |
| KR | 10-2006-0062800 | A | 6/2006 |
| KR | 10-2012-0022808 | A | 3/2012 |

* cited by examiner

DISPLAY APPARATUS AND METHOD OF DRIVING THE SAME

CROSS-REFERENCE TO RELATED APPLICATION

This application claims priority to and the benefit of Korean Patent Application No. 10-2014-0023365, filed on Feb. 27, 2014 in the Korean Intellectual Property Office KIPO, the entire disclosure of which is incorporated herein by reference.

BACKGROUND

1. Field

Aspects of embodiments of the present invention relate to a display apparatus and a method of driving the display apparatus. More particularly, embodiments of the present invention relate to a display apparatus improving a display quality and a method of driving the display apparatus.

2. Description of the Related Art

Recently, a flat display apparatus having a reduced weight and a reduced volume has been developed to substitute for a cathode ray tube. Types of flat display apparatuses include a liquid crystal display ("LCD"), a field emission display ("FED"), a plasma display panel ("PDP"), an organic light emitting display ("OLED"), and so on. The organic light emitting display apparatus displays an image using an organic light emitting diode, which generates light by the combination of an electron and a positive hole. The organic light emitting display apparatus has a quick response time and has low power consumption.

To drive a large OLED apparatus, a display panel may be divided into an upper portion and a lower portion. When the display panel is divided into the upper portion and the lower portion, a stain (or defect or artifact) may be occur at a central portion of the display panel.

SUMMARY

Embodiments of the present invention provide a display apparatus removing a stain (or defect or artifact) at a central portion of a display panel are reduced to improve a display quality of the display panel.

Embodiments of the present invention also provide a method of driving the display apparatus.

in one embodiment of a display apparatus according to the present invention, the display apparatus includes a display panel having a first portion and a second portion, a gate driver configured to drive a first gate line group in the first portion of the display panel starting at a first scan start point and to drive a second gate line group in the second portion of the display panel starting at a second scan start point, the second scan start point being different from the first scan start point, a first data driver configured to output a first data voltage to a first data line group in the first portion, and a second data driver configured to output a second data voltage to a second data line group in the second portion.

The first portion may be an upper portion of the display panel and the second portion may be a lower portion of the display panel. The second scan start point may be earlier than the first scan start point.

The second scan start point may be earlier than the first scan start point by a vertical blank duration of an input image data.

The first portion and the second portion may be continuously scanned.

The first data driver may be configured to output one of a plurality of data voltages applied during an active duration of the input image data to the first portion during the vertical blank duration.

The first data driver may be configured to output a repair pixel voltage to repair a pixel of the first portion during the vertical blank duration.

A first vertical blank duration corresponding to the first portion may be substantially the same as a second vertical blank duration corresponding to the second portion.

The vertical blank duration may vary on a frame-by-frame basis according to the input image data.

The gate driver may include a first gate driver connected to the first gate line group and a second gate driver connected to the second gate line group.

The display apparatus may further include a timing controller configured to control driving timings of the gate driver, the first data driver, and the second data driver. The timing controller may be configured to output a first vertical start signal to the first gate driver and a second vertical start signal to the second gate driver. The timing controller may be configured to output the second vertical start signal before outputting the first vertical start signal.

The gate driver may be commonly connected to the first gate line group and the second gate line group. A first fan-out resistance between the gate driver and a gate line of the first gate line group may be different from a second fan-out resistance between the gate driver and a gate line of the second gate line group.

The gate driver may be closer to the second portion than the first portion.

The display apparatus may further include a timing controller configured to control driving timings of the gate driver, the first data driver, and the second data driver. The timing controller may include an image dividing part configured to divide an input image data into a first image data corresponding to the first portion and a second image data corresponding to the second portion and an image rearranging part configured to rearrange the first image data in a data type of the first data driver and the second image data in a data type of the second data driver.

In one embodiment of a method of driving a display apparatus according to the present invention, the method includes scanning a first gate line group in a first portion of a display panel starting at a first scan start point, scanning a second gate line group in a second portion of the display panel starting at a second scan start point different from the first scan start point, outputting a first data voltage to a first data line group in the first portion of the display panel, and outputting a second data voltage to a second data line group in the second portion of the display panel.

The first portion may be an upper portion of the display panel and the second portion may be a lower portion of the display panel. The second scan start point may be earlier than the first scan start point.

The second scan start point may be earlier than the first scan start point by a vertical blank duration of an input image data.

In one embodiment, the first portion and the second portion may be continuously scanned.

In one embodiment, a first vertical blank duration corresponding to the first portion may be substantially the same as a second vertical blank duration corresponding to the second portion.

In one embodiment, the vertical blank duration may vary on a frame-by-frame basis according to the input image data.

According to the display apparatus and the method of driving the display apparatus according to aspects of embodiments of the present invention, the first portion and the second portion are driven with different timings so that a stain (or defect or artifact) at the central portion of the display panel may be removed or reduced. Thus, a display quality of the display panel may be improved.

BRIEF DESCRIPTION OF THE DRAWINGS

Aspects of embodiments of the present invention will become more apparent by describing in detailed embodiments thereof with reference to the accompanying drawings, in which.

DETAILED DESCRIPTION

Hereinafter, the present invention will be explained in detail with reference to the accompanying drawings.

Figure 1:
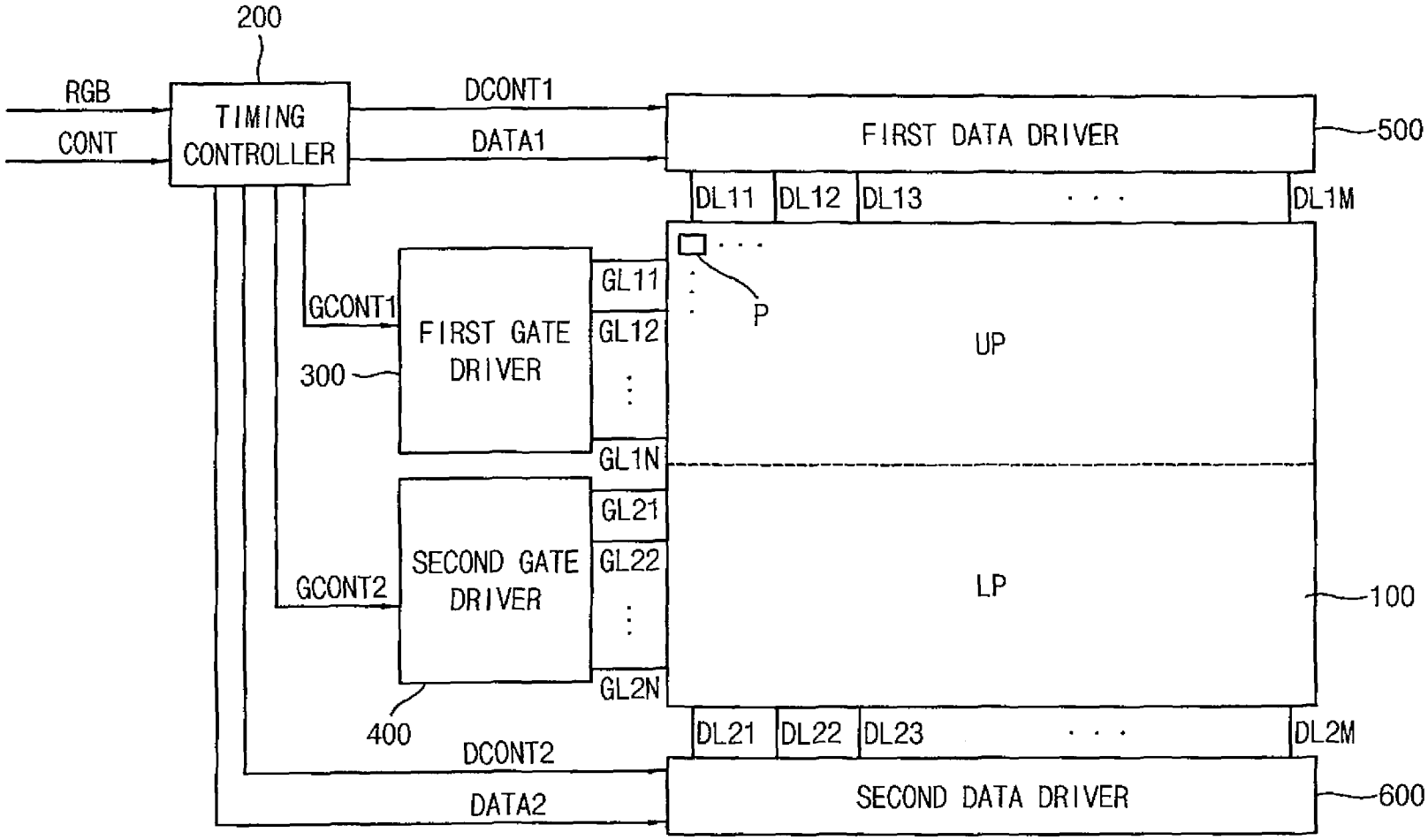
FIG. 1 is a block diagram illustrating a display apparatus according to one embodiment of the present invention.

FIG. 1 is a block diagram illustrating a display apparatus according to one embodiment of the present invention.

Referring to FIG. 1, the display apparatus includes a display panel 100 and a panel driver. The panel driver includes a timing controller 200, a gate driver, a first data driver 500, and a second data driver 600.

In one embodiment, the display apparatus may be an OLED apparatus including organic light emitting diodes.

In one embodiment, the gate driver may include a first gate driver 300 and a second gate driver 400.

The display panel 100 includes a first portion UP which corresponds to an upper portion of the display panel 100 and a second portion LP which corresponds to a lower portion of the display panel 100. A driving timing of the first portion UP may be different from a driving timing of the second portion LP.

The display panel 100 includes a plurality of gate lines, a plurality of data lines, and a plurality of pixels P connected to the gate lines and the data lines. The gate lines may extend in a first direction and the data lines may extend in a second direction crossing the first direction.

Figure 2:
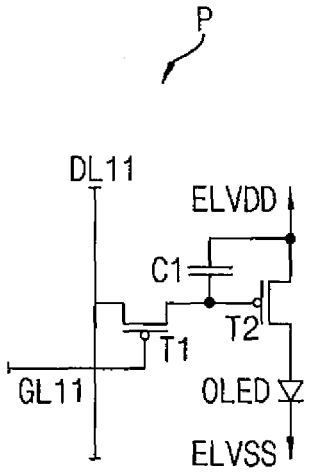
FIG. 2 is a circuit diagram illustrating a pixel of a display panel of FIG. 1.

A pixel structure of the display panel 100 is explained referring to FIG. 2 in detail.

A first gate line group GL11 to GL1N and a first data line group DL11 to DL1M are disposed in the first portion UP of the display panel 100.

A second gate line group GL21 to GL2N and a second data line group DL21 to DL2M are disposed in the second portion LP of the display panel 100.

The timing controller 200 receives input image data RGB and an input control signal CONT from an external apparatus.

The input image data RGB may include red image data R, green image data G, and blue image data B. The input image data RGB may include an active duration (or active period) when active data are inputted and a vertical blank duration when the active data are not inputted and which corresponds to a duration (or time or period) between frames.

The input control signal CONT may include a master clock signal and a data enable signal. The input control signal CONT may further include a vertical synchronizing signal and a horizontal synchronizing signal.

The timing controller 200 generates a first gate control signal GCONT1, a second gate control signal GCONT2, a first data control signal DCONT1, a second data control signal DCONT2, a first data signal DATA1, and a second data signal DATA2 based on the input image data RGB and the input control signal CONT.

The timing controller 200 generates the first gate control signal GCONT1 for controlling an operation of the first gate driver 300 based on the input control signal CONT, and outputs the first gate control signal GCONT1 to the first gate driver 300. The first gate control signal GCONT1 may include a first vertical start signal and a gate clock signal.

The timing controller 200 generates the second gate control signal GCONT2 for controlling an operation of the second gate driver 400 based on the input control signal CONT, and outputs the second gate control signal GCONT2 to the second gate driver 400. The second gate control signal GCONT2 may include a second vertical start signal and the gate clock signal. The second vertical start signal may have a timing different from a timing of the first vertical start signal. For example, the second vertical start signal may have a timing earlier than a timing of the first vertical start signal.

The timing controller 200 generates the first data control signal DCONT1 for controlling an operation of the first data driver 500 based on the input control signal CONT, and outputs the first data control signal DCONT1 to the first data driver 500. The first data control signal DCONT1 may include a first horizontal start signal and a first load signal.

The timing controller 200 generates the first data signal DATA1 corresponding to the first portion UP of the display panel 100 based on the input image data RGB. The timing controller 200 outputs the first data signal DATA1 to the first data driver 500.

The timing controller 200 generates the second data control signal DCONT2 for controlling an operation of the second data driver 500 based on the input control signal CONT, and outputs the second data control signal DCONT2 to the second data driver 500. The second data control signal DCONT2 may include a second horizontal start signal and a second load signal. The second horizontal start signal and the second load signal may respectively have timings different from the first horizontal start signal and the first load signal. For example, the second horizontal start signal and the second load signal may respectively have timings earlier than timings of the first horizontal start signal and the first load signal.

The timing controller 200 generates the second data signal DATA2 corresponding to the second portion LP of the display panel 100 based on the input image data RGB. The timing controller 200 outputs the second data signal DATA2 to the second data driver 600.

An operation and a structure of the timing controller 200 according to one embodiment of the present invention may be explained in more detail below in reference to FIG. 3.

The first gate driver 300 is connected to the first gate line group GL11 to GL1N which is disposed in the first portion UP of the display panel 100 (e.g., among the gate lines in the display panel 100, the first gate driver 300 is coupled only to the first gate line group GL11 to GL1N and not connected to the second gate line group GL21 to GL2N).

The first gate driver 300 generates first gate signals driving the first gate line group GL11 to GL1N in response to the first gate control signal GCONT1 received from the timing controller 200. The first gate driver 300 sequentially outputs the first gate signals to the first gate line group GL11 to GL1N.

The second gate driver 400 is connected to the second gate line group GL21 to GL2N which is disposed in the second portion LP of the display panel 100 (e.g., among the gate lines in the display panel 100, the second gate driver 400 is coupled only to the second gate line group GL21 to GL2N and not connected to the first gate line group GL11 to GL1N).

The second gate driver 400 generates second gate signals driving the second gate line group GL21 to GL2N in response to the second gate control signal GCONT2 received from the timing controller 200. The second gate driver 400 sequentially outputs the second gate signals to the second gate line group GL21 to GL2N.

The first and second gate drivers 300 and 400 may be disposed at a first side of the display panel 100. The first and second gate drivers 300 and 400 may be disposed adjacent to each other along a vertical direction (e.g., along the second direction along which the data lines extend). Alternatively, the first gate driver 300 may be disposed at a first side of the display panel 100 and the second gate driver 400 may be disposed at a second side of the display panel 100 opposite the first side (e.g., the first gate driver 300 and the second gate driver 400 may be spaced apart along the first direction along which the gate lines extend, with the display panel 100 between the first gate driver 300 and the second gate driver 400).

The first and second gate drivers 300 and 400 may be directly mounted on the display panel 100, or may be connected to the display panel 100 as a tape carrier package ("TCP") type. Alternatively, the first and second gate drivers 300 and 400 may be integrated on a peripheral region of the display panel 100.

Figure 4:
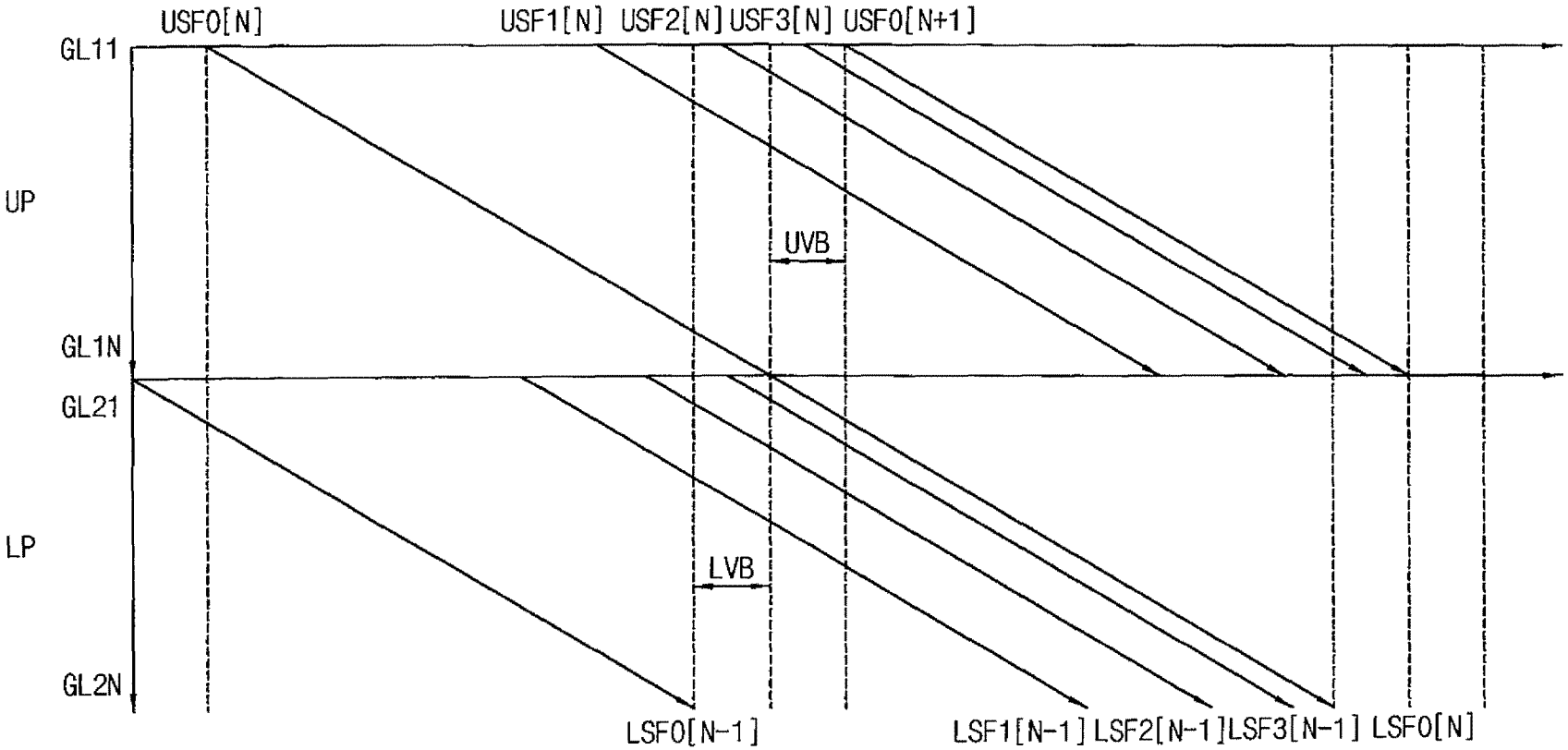
FIG. 4 is a schematic diagram illustrating driving timings of a first portion and a second portion of the display panel of FIG. 1.
Figure 5:
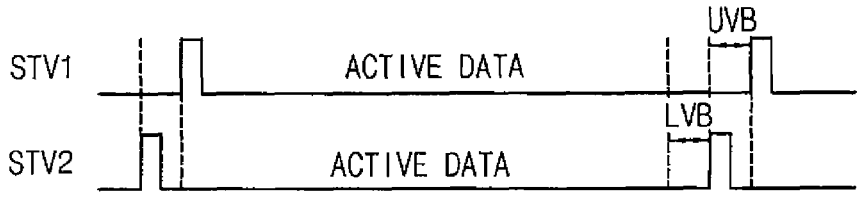
FIG. 5 is a timing diagram illustrating vertical start signals applied to a first gate driver and a second gate driver of FIG. 1.
Figure 6:
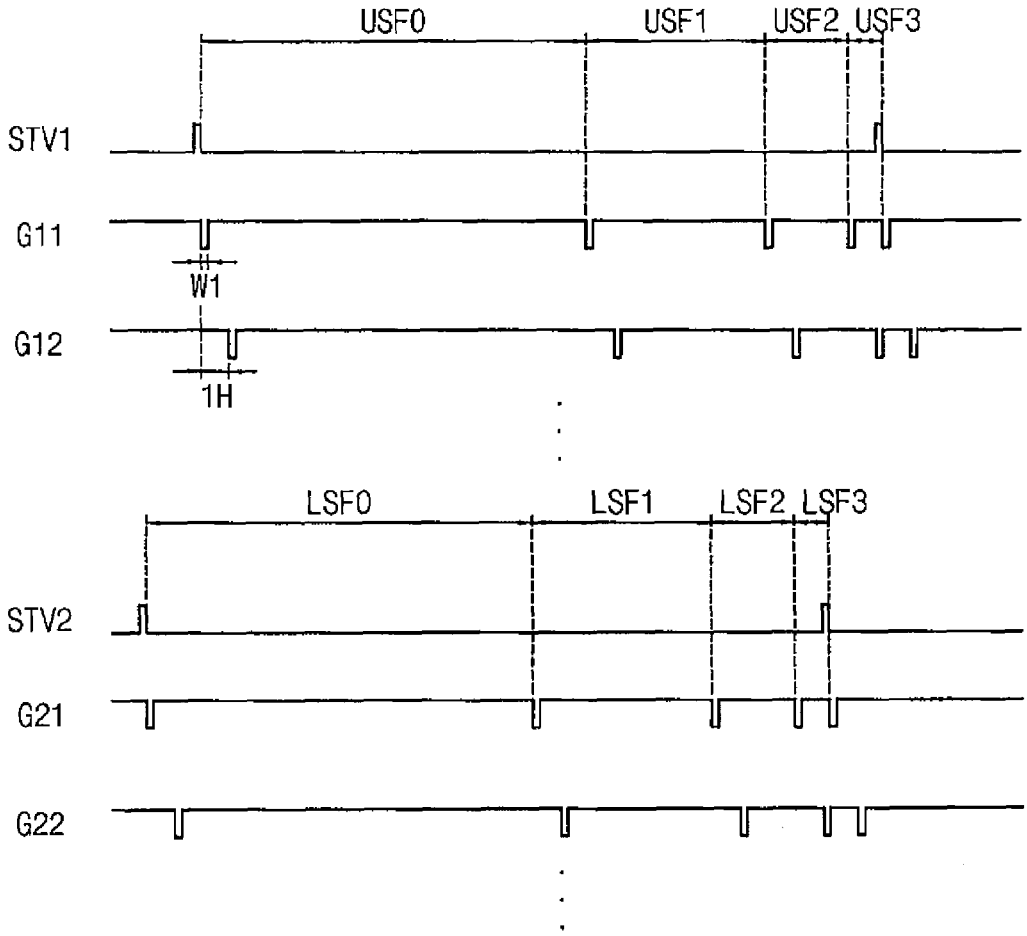
FIG. 6 is a timing diagram illustrating input signals and output signals of the first gate driver and the second gate driver of FIG. 1.

A scanning driving method performed by the first and second gate drivers 300 and 400 is explained in more detail in reference to FIGS. 4, 5, and 6.

The first data driver 500 is connected to the first data line group DL11 to DL1M which is disposed in the first portion UP of the display panel 100.

The first data driver 500 receives the first data control signal DCONT1 and the first data signal DATA1 from the timing controller 200. The first data driver 500 converts the first data signal DATA1 into first data voltages. The first data driver 500 outputs the first data voltages to the first data line group DL11 to DL1M.

The second data driver 600 is connected to the second data line group DL21 to DL2M which is disposed in the second portion LP of the display panel 100. Data lines DL21 to DL2M in the second data line group are not connected to (or disconnected from) the data lines DL11 to DL1M in the first data line group.

The second data driver 600 receives the second data control signal DCONT2 and the second data signal DATA2 from the timing controller 200. The second data driver 600 converts the second data signal DATA2 into second data voltages. The second data driver 600 outputs the second data voltages to the second data line group DL21 to DL2M.

The first data driver 500 may be disposed at an upper side of the display panel 100 and the second data driver 600 may be disposed at a lower side of the display panel 100. The first and second data drivers 500 and 600 may face each other (e.g., aligned along the second direction along which the data lines extend), with the display panel 100 between the first and second data drivers 500 and 600.

The first and second data drivers 500 and 600 may be directly mounted on the display panel 100, or may be connected to the display panel 100 in a TCP type connection. Alternatively, the first and second data drivers 500 and 600 may be integrated on the peripheral region of the display panel 100.

FIG. 2 is a circuit diagram illustrating a pixel P of the display panel 100 of FIG. 1.

Referring to FIGS. 1 and 2, the pixel P includes a first switching element T1, a second switching element T2, a storing capacitor C1, and an organic light emitting element OLED.

The first switching element T1 may be a thin film transistor. The first switching element T1 includes a control electrode connected to the gate line GL11, an input electrode connected to the data line DL11, and an output electrode connected to a control electrode of the second switching element T2.

The control electrode of the first switching element T1 may be a gate electrode. The input electrode of the first switching element T1 may be a source electrode. The output electrode of the first switching element T1 may be a drain electrode.

The second switching element T2 includes a control electrode connected to the output electrode of the first switching element T1, an input electrode to which a first power voltage ELVDD is applied, and an output electrode connected to a first electrode of the organic light emitting element OLED.

The second switching element T2 may be a thin film transistor. The control electrode of the second switching element T2 may be a gate electrode. The input electrode of the second switching element T2 may be a source electrode. The output electrode of the second switching element T2 may be a drain electrode.

A first terminal of the storing capacitor C1 is connected to the input electrode of the second switching element T2. A second terminal of the storing capacitor C1 is connected to the output electrode of the first switching element T1.

The first electrode of the organic light emitting element OLED is connected to the output electrode of the second switching element T2. A second power voltage ELVSS is applied to the second electrode of the organic light emitting element OLED.

The first electrode of the organic light emitting element OLED may be an anode electrode. The second electrode of the organic light emitting element OLED may be a cathode electrode.

The pixel P receives the gate signal, the data signal, the first power voltage ELVDD and the second power voltage ELVSS and emits light having a luminance corresponding to the data signal to display an image.

In one embodiment, the pixels P of the display panel 100 may be driven in a digital driving method.

In the digital driving method of the pixel, the second transistor T2 is operated as a switch in a linear region.

Accordingly, the second transistor T2 represents one of a turn on status and a turn off status.

To turn on or turn off the second transistor T2, data voltages having two levels including a turn on level and a turn off level are used. In the digital driving method, the pixel represents one of the turn on status and the off status so that a single frame may be divided into a plurality of subfields to represent various gray levels (or gray scale levels). The turn on status and the turn off status of the pixel during each of the subfields are combined so that the various gray levels (or gray scale levels) of the pixel may be represented.

Figure 3:
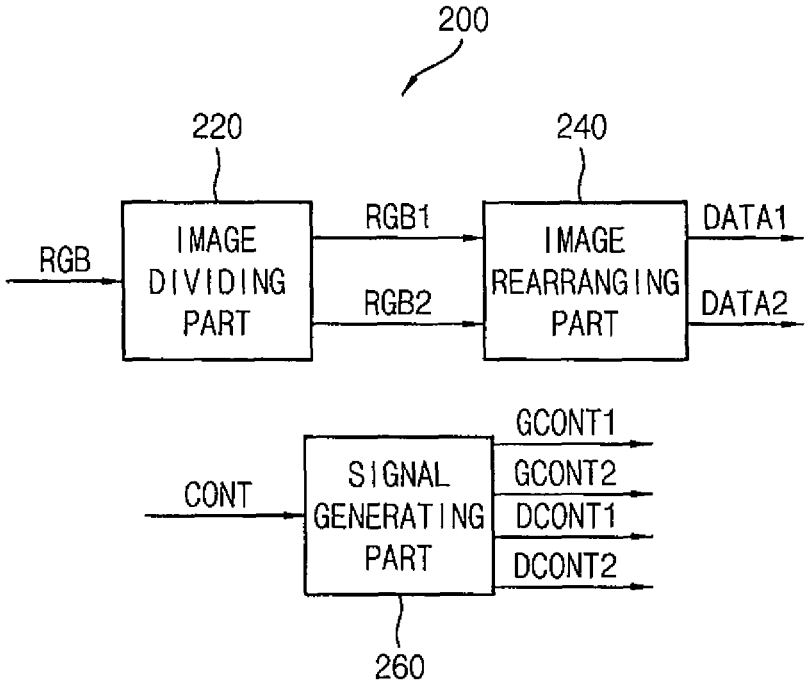
FIG. 3 is a block diagram illustrating a timing controller of FIG. 1.

FIG. 3 is a block diagram illustrating the timing controller 200 of FIG. 1.

Referring to FIGS. 1, 2, and 3, the timing controller 200 includes an image dividing part 220, an image rearranging part 240, and a signal generating part 260.

The image dividing part 220 receives the input image data RGB. The image dividing part 220 divides the input image data RGB into a first image data RGB1 and a second image data RGB2. The first image data RGB1 corresponds to (e.g., corresponds to the image to be displayed on) the first portion UP of the display panel 100. The second image data RGB2 corresponds to (e.g., corresponds to the image to be displayed on) the second portion LP of the display panel 100. The image dividing part 220 outputs the first image data RGB1 and the second image data RGB2 to the image rearranging part 240.

The image rearranging part 240 rearranges the first image data RGB1 in a data type of the first data driver 500 to generate the first data signal DATA1. The image rearranging part 240 rearranges the second image data RGB2 in a data type of the second data driver 600 to generate the second data signal DATA2. The image rearranging part 240 outputs the first data signal DATA1 to the first data driver 500. The image rearranging part 240 outputs the second data signal DATA2 to the second data driver 600.

The timing controller 200 may further include an image compensating part to compensate the first image data RGB1 and the second image data RGB2. The image compensating part may include an adaptive color correction ("ACC") part and a dynamic capacitance compensating ("DCC") part.

The ACC part receives gray level (or grayscale level) data of the first and second image data RGB1 and RGB2 and operates the adaptive color correction. The ACC part may compensate the gray level (or grayscale level) data using a gamma curve.

The DCC part operates the dynamic capacitance compensation to compensate gray level (or grayscale level) data of a present frame data using a previous frame data and the present (or current) frame data.

The signal generating part 260 receives the input control signal CONT. The signal generating part 260 generates the first gate control signal GCONT1 controlling a driving timing of the first gate driver 300 and the second gate control signal GCONT2 controlling a driving timing of the second gate driver 400 based on the input control signal CONT. The signal generating part 260 generates the first data control signal DCONT1 controlling a driving timing of the first data driver 500 and the second data control signal DCONT2 controlling a driving timing of the second data driver 600 based on the input control signal CONT.

The signal generating part 260 outputs the first gate control signal GCONT1 to the first gate driver 300. The signal generating part 260 outputs the second gate control signal GCONT2 to the second gate driver 400. The signal generating part 260 outputs the first data control signal DCONT1 to the first data driver 500. The signal generating part 260 outputs the second data control signal DCONT2 to the second data driver 600.

FIG. 4 is a schematic diagram illustrating driving timings of the first portion UP and the second portion LP of the display panel 100 of FIG. 1. FIG. 5 is a timing diagram illustrating vertical start signals applied to the first gate driver 300 and the second gate driver 400 of FIG. 1. FIG. 6 is a timing diagram illustrating input signals and output signals of the first gate driver 300 and the second gate driver 400 of FIG. 1.

Referring to FIGS. 1, 2, 3, 4, 5, and 6, the first gate driver 300 scans the first gate line group GL11 to GL1N disposed at the first portion UP of the display panel 100 from a first scan start point (or a first scan start time point). The first data driver 500 is synchronized with the scanning of the first gate driver 300 and outputs a first data voltage to the first data line group DL11 to DL1M.

The second gate driver 400 scans the second gate line group GL21 to GL2N disposed at the second portion LP from a second scan start point (or second scan start time point). The second data driver 600 is synchronized with the scanning of the second gate driver 400 and outputs a second data voltage to the second data line group DL21 to DL2M.

The pixels P of the display panel 100 are driven in a digital driving method. In addition, the pixels P of the display panel 100 are driven in a progressive emission method. A single frame may be divided into a plurality of subfields.

In one embodiment, a single frame is divided into four subfields SF0, SF1, SF2, and SF3. In addition, the four subfields SF0, SF1, SF2, and SF3 are generated by a binary type so that the durations of the four subfields SF0, SF1, SF2 and SF3 have a ratio of 8:4:2:1. However, embodiments of the present invention is not limited the number of the subfields or the duration of the subfields.

The second scan start point (or second scan start time point) of the second portion LP is earlier than the first scan start point (or first scan start time point) of the first portion UP. For example, the second scan start point of the second portion LP may be earlier than the first scan start point of the first portion UP by a vertical blank duration UVB and LVB (or a period of time equal in length to a vertical blank duration UVB and LVB).

For example, a first vertical blank duration UVB corresponding to the first portion UP may be substantially the same as a second vertical blank duration LVB corresponding to the second portion LP.

If the second scan start point of the second portion LP is the same (e.g., the same time) as the first scan start point of the first portion UP, a discontinuous emitting pattern due to the vertical blank duration UVB and LVB may occur at the central portion of the display panel 100 which corresponds to a boundary of the first portion UP and the second portion LP.

When a luminance of an image corresponding to the vertical blank duration is relatively bright, a bright stain (or defect or artifact) may occur (or be displayed) at the central portion of the display panel 100 due to the discontinuous emitting pattern. When a luminance of an image corresponding to the vertical blank duration is relatively dark, a dark stain (or defect or artifact) may occur (or be displayed) at the central portion of the display panel 100 due to the discontinuous emitting pattern.

In one embodiment of the present invention, the second scan start point of the second portion LP is earlier than (e.g., occurs before) the first scan start point of the first portion UP by the vertical blank duration UVB and LVB so that the first portion UP and the second portion LP may be continuously scanned. Thus, the discontinuous emitting pattern may not be generated at the central portion of the display panel 100. Therefore, the appearance of a stain (or defect or artifact) at the central portion of the display panel 100 may be prevented or reduced.

For example, during the vertical blank duration UVB and LVB, the first data driver 500 may display a black image or a white image at the first portion UP. During the vertical blank duration UVB and LVB, the second data driver 600 may display a black image or a white image at the second portion LP.

Alternatively, during the vertical blank duration UVB and LVB, the first data driver 500 may output one of the data voltages applied during an active duration (or active period) of the input image data RGB to the first portion UP. During the vertical blank duration UVB and LVB, the second data driver 600 may output one of the data voltages applied during the active duration to the second portion LP.

If the first and second data drivers 500 and 600 display the black image or the white image in the first and second portions UP and LP during the vertical blank duration UVB and LVB and the display panel 100 displays a single color image, a precharge data which is supplied to another subfield has a luminance different from a luminance of the single color so that a stain (or defect or artifact) may be generated (or displayed).

If the first and second data drivers 500 and 600 output one of the data voltages applied during the active duration at the first and second portions UP and LP during the vertical blank duration UVB and LVB, the abovementioned precharge data defect may be reduced or prevented.

Alternatively, the first data driver 500 may output a repair pixel voltage to repair the pixel of the first portion UP during the vertical blank duration UVB and LVB. The second data driver 600 may output a repair pixel voltage to repair the pixel of the second portion LP during the vertical blank duration UVB and LVB.

The display panel 100 may further include a repair pixel in an upper dummy area in the first portion UP and a first repair line group including repair lines parallel to the data lines in the first data line group to repair the pixel of the first portion UP. The display panel 100 may further include a repair pixel in a lower dummy area in the second portion LP and a second repair line group including repair lines parallel to the data lines in the second data line group to repair the pixel of the second portion LP.

A frame rate of the input image data RGB may vary. Accordingly, the vertical blank duration may vary per frames (e.g., on a frame-by-frame basis). The second scan start point is naturally set by the first scan start point and the variable vertical blank duration so that the display quality of the display panel 100 may be improved for the input image data RGB having the variable vertical blank duration.

In one embodiment, a second vertical start signal STV2 which is used to generate the gate signal of the second gate driver 400 may have a timing earlier than a timing of a first vertical start signal STV1 which is used to generate the gate signal of the first gate driver 300. For example, the timing controller may be configured to supply the second vertical start signal STV2 before supplying the first vertical start signal STV1.

A first gate signal of the second gate driver 400 may be earlier than a first gate signal of the first gate driver 300 by the vertical blank duration. A second gate signal of the second gate driver 400 may be earlier than a second gate signal of the first gate driver 300 by the vertical blank duration.

In one embodiment, the single frame is divided into four subfields so that a width W1 of a gate pulse may be ¼ of a horizontal time 1H. One gate pulse corresponding to a second subfield USF1, one gate pulse corresponding to a third subfield USF2, and one gate pulse corresponding to a fourth subfield USF3 of the single frame may be turned on (or supplied) between a gate pulse of a first gate signal G11 and a gate pulse of a second gate signal G12 corresponding to the first subfield USF0.

According to one embodiment, the first portion UP and the second portion LP are driven in a different timing so that the stain (or defect or artifact) in the central portion of the display panel 100 may be prevented or reduced. Thus, a display quality of the display panel 100 may be improved.

Figure 7:
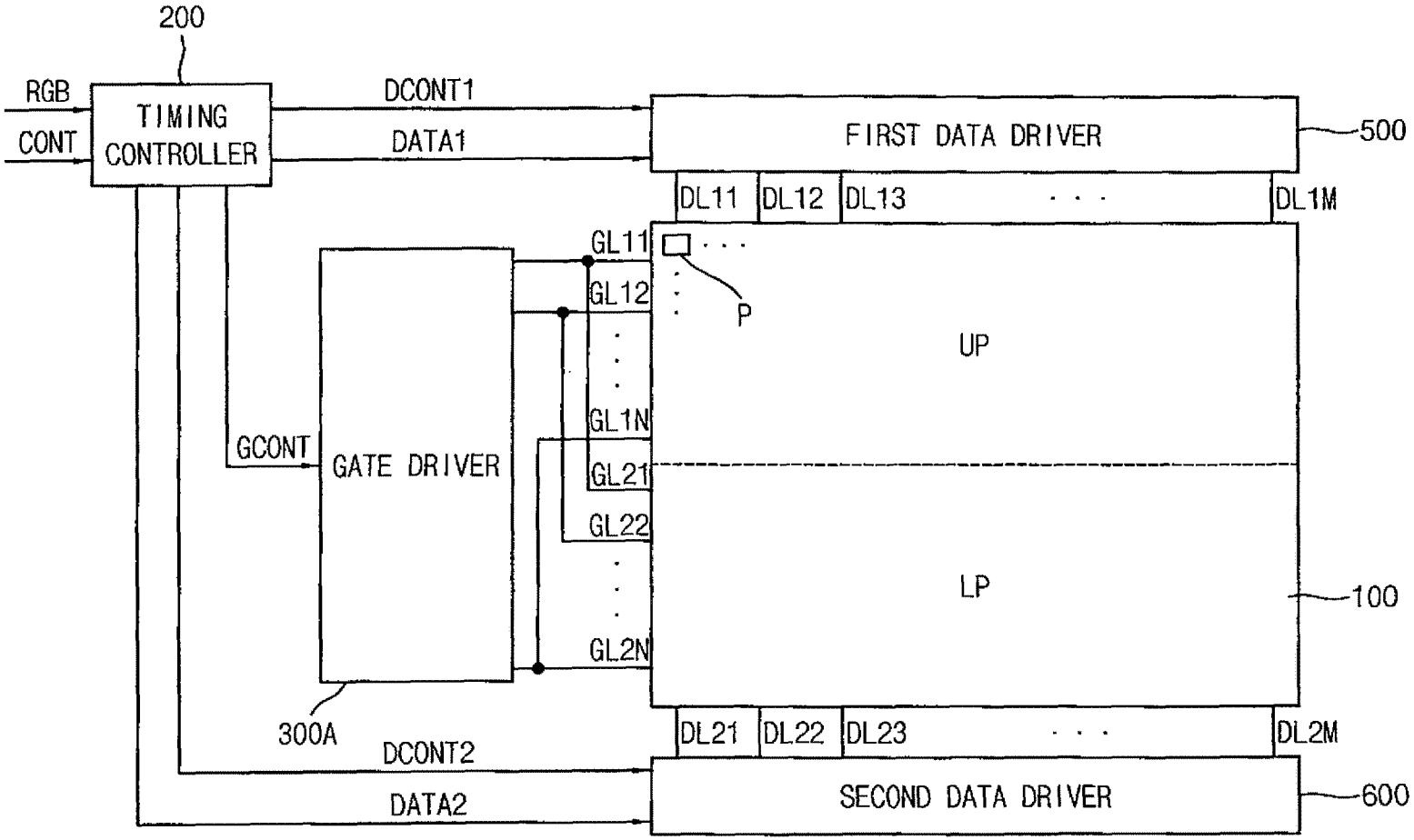
FIG. 7 is a block diagram illustrating a display apparatus according to one embodiment of the present invention.

FIG. 7 is a block diagram illustrating a display apparatus according to one embodiment of the present invention.

The display apparatus according to one embodiment is substantially the same as the display apparatus of the embodiments described in reference to FIGS. 1, 2, 3, 4, 5, and 6 except for a structure of the gate driver. Thus, the same reference numerals will be used to refer to the same or like parts as those described above with respect to FIGS. 1, 2, 3, 4, 5, and 6 and any repetitive explanation concerning the above elements will be omitted.

Referring to FIGS. 2, 3, 4, 5, 6, and 7, the display apparatus includes a display panel 100 and a panel driver. The panel driver includes a timing controller 200, a gate driver 300A, a first data driver 500, and a second data driver 600.

In one embodiment, the gate driver 300A is commonly connected to the first gate line group GL11 to GL1N and the second gate line group GL21 to GL2N.

A first fan-out resistance (or fan-out impedance) between the gate driver 300A and a gate line in the first gate line group GL11 to GL1N may be different from a second fan-out resistance between the gate driver 300A and a gate line in the second gate line group GL21 to GL2N. The first fan-out resistance may be greater than the second fan-out resistance.

By adjusting the first and second fan-out resistances, a first gate signal of the second gate line group may be adjusted to be earlier than a first gate signal of the first gate line group by the vertical blank duration. In addition, by adjusting the first and second fan-out resistances, a second gate signal of the second gate line group may be adjusted to be earlier than a second gate signal of the first gate line group by the vertical blank duration. In one embodiment, a single vertical start signal may be applied to the gate driver 300A.

According to one embodiment, the first portion UP and the second portion LP are driven in a different timing so that the stain (defect or artifact) in the central portion of the display panel 100 may be prevented or reduced. Thus, a display quality of the display panel 100 may be improved.

Figure 8:
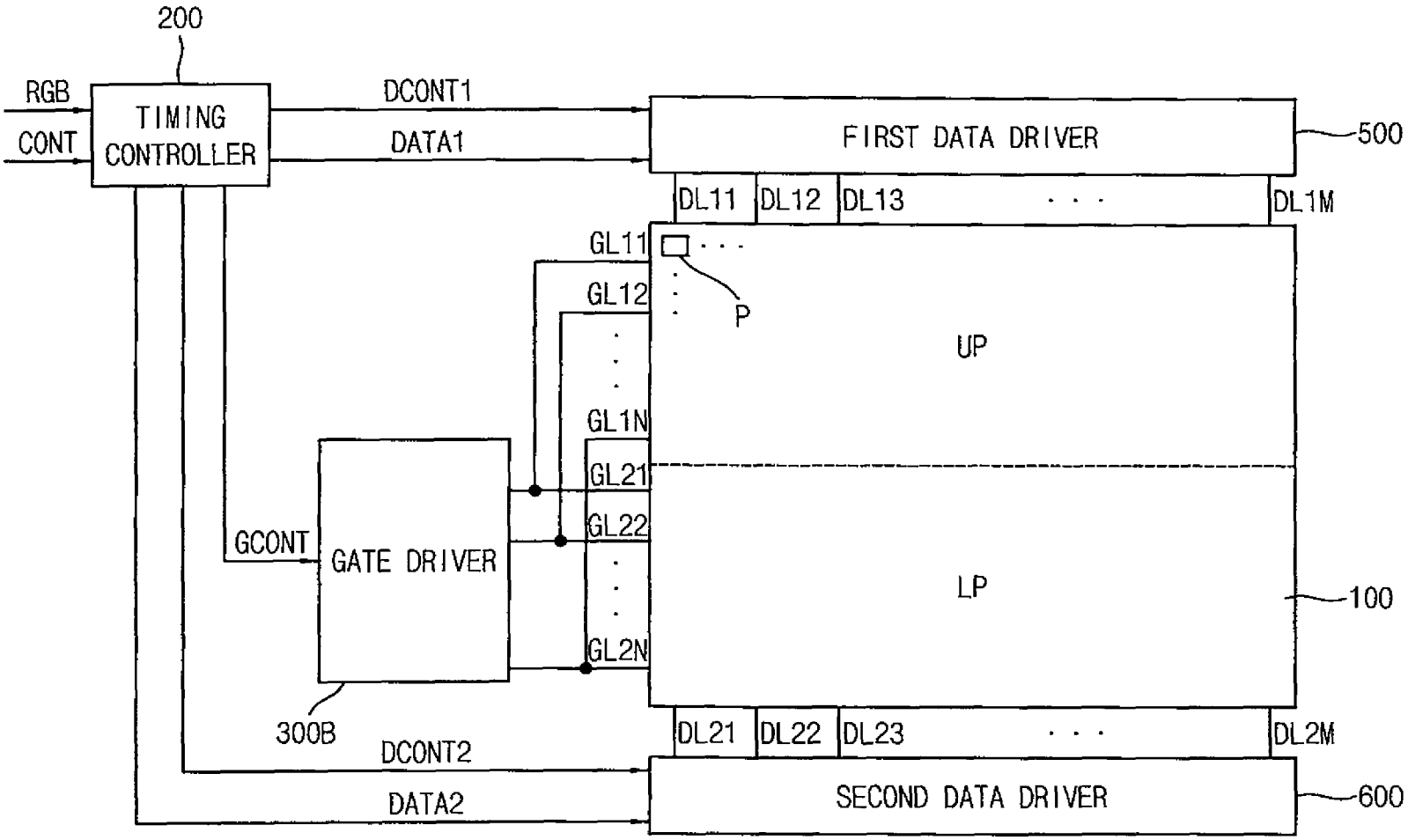
FIG. 8 is a block diagram illustrating a display apparatus according to one embodiment of the present invention.

FIG. 8 is a block diagram illustrating a display apparatus according to one embodiment of the present invention.

The display apparatus according to one embodiment is substantially the same as the display apparatus of the embodiments explained referring to FIGS. 1, 2, 3, 4, 5, and 6 except for a structure of the gate driver. Thus, the same reference numerals will be used to refer to the same or like parts as those described in the embodiments of FIGS. 1, 2, 3, 4, 5, and 6 and any repetitive explanation concerning the above elements will be omitted.

Referring to FIGS. 2, 3, 4, 5, 6, and 8, the display apparatus according to one embodiment includes a display panel 100 and a panel driver. The panel driver includes a timing controller 200, a gate driver 300B, a first data driver 500, and a second data driver 600.

In one embodiment, the gate driver 300B is commonly connected to the first gate line group GL11 to GL1N and the second gate line group GL21 to GL2N.

A first fan-out resistance between the gate driver 300B and a gate line in the first gate line group GL11 to GL1N may be different from a second fan-out resistance between the gate driver 300B and a gate line in the second gate line group GL21 to GL2N.

In one embodiment, the gate driver 300B is disposed close to the second portion LP compared to the first portion UP. Thus, the first fan-out resistance may be greater than the second fan-out resistance.

By adjusting the first and second fan-out resistances, a first gate signal of the second gate line group may be adjusted to be earlier than a first gate signal of the first gate line group by the vertical blank duration. In addition, by adjusting the first and second fan-out resistances, a second gate signal of the second gate line group may be adjusted to be earlier than a second gate signal of the first gate line group by the vertical blank duration. In one embodiment, a single vertical start signal may be applied to the gate driver 300A.

According to one embodiment, the first portion UP and the second portion LP are driven in a different timing so that the stain (or defect or artifact) in the central portion of the display panel 100 may be prevented or reduced. Thus, a display quality of the display panel 100 may be improved.

According to aspects of embodiments of the present invention as explained above, the display panel 100 is divided into the first portion UP and the second portion LP and the first portion UP and the second portion LP are respectively driven. In some embodiments, the driving timing of the first portion UP is different from the driving timing of the second portion LP so that a light emitting pattern of the display panel 100 may be continuously formed. Thus, a stain (or defect or artifact) at the central portion of the display panel 100 is prevented or reduced so that a display quality of the display panel 100 may be improved.

The foregoing is illustrative of the present invention and is not to be construed as limiting thereof. Although a few embodiments of the present invention have been described, those skilled in the art will readily appreciate that many modifications are possible in the embodiments without materially departing from embodiments of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. Embodiments of the present invention are defined by the following claims and equivalents thereof.

What is claimed is:

1. A display apparatus comprising:

a display panel having a first portion comprising a first plurality of pixels and a second portion comprising a second plurality of pixels;

a gate driver configured to drive a first gate line group in the first portion of the display panel sequentially from a first gate line of the first gate line group to a last gate line of the first gate line group starting at a first scan start point and to drive a second gate line group in the second portion of the display panel sequentially from a first gate line of the second gate line group to a last gate line of the second gate line group starting at a second scan start point, the second scan start point being different from the first scan start point, the first plurality of pixels comprising each of the pixels coupled to the first gate line group and the second plurality of pixels comprising each of the pixels coupled to the second gate line group;

a first data driver configured to output a first data voltage to a first data line group in the first portion, the first data line group being coupled to each pixel of the first plurality of pixels; and a second data driver configured to output a second data voltage to a second data line group in the second portion, the second data line group being coupled to each pixel of the second plurality of pixels, wherein the first portion is an upper portion of the display panel and the second portion is a lower portion of the display panel, wherein the last gate line of the first gate line group is adjacent to the first gate line of the second gate line group, and wherein the second scan start point is earlier than the first scan start point.

2. The display apparatus of claim 1, wherein the second scan start point is earlier than the first scan start point by a vertical blank duration of an input image data.

3. The display apparatus of claim 2, wherein the first portion and the second portion are continuously scanned.

4. The display apparatus of claim 2, wherein the first data driver is configured to output one of a plurality of data voltages applied during an active duration of the input image data to the first portion during the vertical blank duration.

5. The display apparatus of claim 2, wherein the first data driver is configured to output a repair pixel voltage to repair a pixel of the first portion during the vertical blank duration.

6. The display apparatus of claim 2, wherein a first vertical blank duration corresponding to the first portion is substantially the same as a second vertical blank duration corresponding to the second portion.

7. The display apparatus of claim 2, wherein the vertical blank duration varies on a frame-by-frame basis according to the input image data.

8. The display apparatus of claim 1, wherein the gate driver comprises:

a first gate driver connected to the first gate line group; and a second gate driver connected to the second gate line group.

9. The display apparatus of claim 8, further comprising a timing controller configured to control driving timings of the gate driver, the first data driver, and the second data driver, wherein the timing controller is configured to output a first vertical start signal to the first gate driver and a second vertical start signal to the second gate driver, and wherein the timing controller is configured to output the second vertical start signal before outputting the first vertical start signal.

10. The display apparatus of claim 1, wherein the gate driver is commonly connected to the first gate line group and the second gate line group, and wherein a first fan-out resistance between the gate driver and a gate line of the first gate line group is different from a second fan-out resistance between the gate driver and a gate line of the second gate line group.

11. The display apparatus of claim 10, wherein the gate driver is closer to the second portion than to the first portion.

12. The display apparatus of claim 1, further comprising a timing controller configured to control driving timings of the gate driver, the first data driver, and the second data driver, wherein the timing controller comprises:

an image dividing part configured to divide an input image data into a first image data corresponding to the first portion and a second image data corresponding to the second portion; and an image rearranging part configured to rearrange the first image data in a data type of the first data driver and the second image data in a data type of the second data driver.

13. A method of driving a display apparatus comprising a plurality of pixels, the method comprising:

scanning a first gate line group in a first portion of a display panel sequentially from a first gate line of the first gate line group to a last gate line of the first gate line group starting at a first scan start point, the first portion of the display panel comprising a first plurality of pixels, the first plurality of pixels comprising each of the pixels coupled to the first gate line group;

scanning a second gate line group in a second portion of the display panel sequentially from a first gate line of the second gate line group to a last gate line of the second gate line group starting at a second scan start point different from the first scan start point, the second portion of the display panel comprising a second plurality of pixels, the second plurality of pixels comprising each of the pixels coupled to the second gate line group;

outputting a first data voltage to a first data line group in the first portion of the display panel, the first data line group being coupled to each pixel of the first plurality of pixels; and outputting a second data voltage to a second data line group in the second portion of the display panel, the second data line group being coupled to each pixel of the second plurality of pixels, wherein the first portion is an upper portion of the display panel and the second portion is a lower portion of the display panel, wherein the last gate line of the first gate line group is adjacent to the first gate line of the second gate line group, and wherein the second scan start point is earlier than the first scan start point.

14. The method of claim 13, wherein the second scan start point is earlier than the first scan start point by a vertical blank duration of an input image data.

15. The method of claim 14, wherein the first portion and the second portion are continuously scanned.

16. The method of claim 14, wherein a first vertical blank duration corresponding to the first portion is substantially the same as a second vertical blank duration corresponding to the second portion.

17. The method of claim 14, wherein the vertical blank duration varies on a frame-by-frame basis according to the input image data.

* * * * *